US008911215B2

(12) United States Patent
Cornelius et al.

(10) Patent No.: US 8,911,215 B2
(45) Date of Patent: Dec. 16, 2014

(54) COMPRESSOR BLADE FOR AN AXIAL COMPRESSOR

(75) Inventors: Christian Cornelius, Sprockhövel (DE); Georg Kröger, Köln (DE); Eberhard Nicke, Köln (DE)

(73) Assignee: Siemens Aktiengesellschaft, Munich (DE)

( * ) Notice: Subject to any disclaimer, the term of this patent is extended or adjusted under 35 U.S.C. 154(b) by 393 days.

(21) Appl. No.: 13/393,264

(22) PCT Filed: Aug. 10, 2010

(86) PCT No.: PCT/EP2010/061580
§ 371 (c)(1), (2), (4) Date: Apr. 26, 2012

(87) PCT Pub. No.: WO2011/026714
PCT Pub. Date: Mar. 10, 2011

(65) Prior Publication Data

US 2012/0230834 A1 Sep. 13, 2012

(30) Foreign Application Priority Data

Sep. 4, 2009 (EP) ..... 09011392

(51) Int. Cl.
*F01D 5/14* (2006.01)
*F04D 29/32* (2006.01)

(52) U.S. Cl.
CPC ..... *F04D 29/324* (2013.01); *F05D 2250/711* (2013.01); *F01D 5/141* (2013.01); *F05D 2250/712* (2013.01); *Y10S 416/05* (2013.01); *Y10S 416/02* (2013.01)
USPC .. 416/242; 416/243; 416/DIG. 5; 416/DIG. 2

(58) Field of Classification Search
USPC ..... 416/235, 242, 243, DIG. 2, DIG. 5
See application file for complete search history.

(56) References Cited

U.S. PATENT DOCUMENTS

| | | | | |
|---|---|---|---|---|
| 5,492,448 | A * | 2/1996 | Perry et al. | 416/228 |
| 6,116,856 | A * | 9/2000 | Karadgy et al. | 416/203 |
| 6,264,429 | B1 | 7/2001 | Koeller et al. | |
| 7,195,456 | B2 * | 3/2007 | Aggarwala et al. | 416/233 |
| 7,597,544 | B2 | 10/2009 | Hasenjäger et al. | |
| 2005/0141991 | A1 | 6/2005 | Frutschi | |
| 2006/0275134 | A1 | 12/2006 | Arima | |

FOREIGN PATENT DOCUMENTS

| | | |
|---|---|---|
| CN | 1299003 | 6/2001 |
| DE | 102005025213 A1 | 12/2006 |
| EP | 0991866 A1 | 4/2000 |
| EP | 0991866 B1 | 8/2003 |

(Continued)

*Primary Examiner* — Igor Kershteyn

(57) ABSTRACT

A compressor blade for an axially permeated compressor, preferably of a stationary gas turbine is provided. The camber line of the blade tip side profile of the blade of the compressor blade includes at least two inflection points for reducing radial gap losses. By means of two inflection points, there is a concavely designed suction side contour segment in a segment from 35% to 50% for the suction side contour, and a convexly implemented pressure side contour segment for the pressure side contour. It is possible by means of the geometry to generate low-loss gap vortices, in order to increase the overall efficiency of an axial compressor including the compressor blades.

20 Claims, 3 Drawing Sheets

(56) References Cited

FOREIGN PATENT DOCUMENTS

| | | | |
|---|---|---|---|
| EP | 2022988 | A1 | 2/2009 |
| GB | 2106192 | A | 4/1983 |
| JP | 7012094 | | 1/1995 |
| JP | 8114199 | | 5/1996 |
| JP | 9032501 | | 2/1997 |
| JP | 2006336637 | A | 12/2006 |
| JP | 2007315303 | A | 12/2007 |
| SU | 1751430 | A1 | 7/1992 |

* cited by examiner

COMPRESSOR BLADE FOR AN AXIAL COMPRESSOR

CROSS REFERENCE TO RELATED APPLICATIONS

This application is the US National Stage of International Application No. PCT/EP2010/061580, filed Aug. 10, 2010 and claims the benefit thereof. The International Application claims the benefits of European Patent Office application No. 09011392.9 EP filed Sep. 4, 2009. All of the applications are incorporated by reference herein in their entirety.

FIELD OF INVENTION

The invention refers to a compressor rotor blade for an axial compressor according to the features of the preamble of the claims.

BACKGROUND OF INVENTION

Compressor blades for axial compressors are known extensively from the prior art. For example, EP 0 991 866 B1 discloses a compressor blade having a profile, the suction-side contour of which, at a suction-side intersection point with a reference line perpendicularly intersecting the profile chord at 5% of the length of said profile chord, has a curvature radius which is smaller than half the length of the profile chord. As a result, the effect to be achieved is that after a comparatively short stretch of circumflow around the blade airfoil on the suction side the velocity maximum is reached and the location of transfer of the flow from laminar to turbulent coincides with the location of the velocity maximum, as a result of which this profile has a particularly large operating range in which it efficiently compresses the gas flow.

Furthermore, it is known that so-called radial gas losses occur on the blade airfoil tips of compressor rotor blades. In this case, some of the pressure gain during operation of the axial compressor is lost as a result of a leakage flow being established across the blade airfoil tip from a pressure side of the blade airfoil to a suction side of the blade airfoil. In order to reduce this leakage flow, it is known that a radial gap, formed between the blade airfoil tips and an annular wall—lying opposite this—of the compressor duct, is always to be minimized as far as possible. Nevertheless, minimum values of gap dimensions must be maintained in this case in order to avoid rubbing of blade airfoil tips against the annular wall. This applies in this case particularly to transient operating states in which thermally induced expansions both of duct wall and of rotor blades are still not completed.

Moreover, it was frequently the case that the previous profiling of blade airfoil tips was adapted only to the specific inflow conditions in the region of the annular wall.

The actual profiling, however, was carried out without taking into consideration the actual three-dimensional flow effects on the blade airfoil tips. Conventionally designed blade airfoil profilings were therefore not optimally adapted to the complex flow conditions in the region of the blade airfoil tip. As a result, a notable improvement potential exists particularly in the case of compressor rotor blades with a small span and large relative gap depths (with regard to the span).

Since modern turbomachine blading arrangements, as known from EP 0 991 866 B1, have in the meantime achieved very high aerodynamic efficiency, there arises—with the tendency towards ever higher profile loads—an increasing proportion of the overall losses as a result these radial gap losses which occur in the outer region of the annulus close to the wall. A reduction of these appreciable losses therefore brings about a significant improvement of the efficiency of turbomachines and of axial compressors.

In order to reduce these radial gap losses, it is known from SU 1 751 430-A1, for example, to design the blade airfoil tip of rotor blades of an axial compressor according to the shape of an S. The camber line of the profile is formed by two opposed arcs which merge into each other at an inflection point. The inflection point is located in this case in the region of between 5% and 15% of the relative chord length. As a result of this, secondary flow losses and irregularities of the flow at the exit of subsonic compressor blades are reduced on account of the reduction of the pressure gradient. In particular, the pressure gradient in the front region and center region in the passages between the rotor blades is to be reduced in this case. According to SU 1 751 430-A1, the leading edge region is turned in the direction of the suction side of the blade airfoil, as a result of which the front, i.e. upstream, region of the profile has an inverse curvature in comparison to the rear, i.e. downstream, region of the blade profile.

In spite of the already existing solutions, there is still great interest in the reduction of radial gap losses of turbomachines in order to further increase the efficiency of these machines.

SUMMARY OF INVENTION

The object of the invention is the provision of a compressor rotor blade with a blade airfoil tip which particularly has low leakage flows and radial gap losses during operation in a turbomachine.

This object is achieved with a compressor rotor blade for an axial compressor, having a curved blade airfoil, which comprises a pressure-side wall and a suction-side wall which, on the one hand, extend in each case from a common leading edge to a common trailing edge and, on the other hand, extend from a fastening-side blade airfoil end to a blade airfoil tip, forming a span, wherein for each blade airfoil height which exists along the span the blade airfoil has a profile with a suction-side contour and a pressure-side contour, an at least partially curved camber line, and a rectilinear profile chord, which contours, camber line and profile chord extend in each case from a leading edge point arranged on the leading edge to a trailing edge point arranged on the trailing edge, wherein at least one of the camber lines of the profile have at least two inflection points in a region of the blade airfoil tip (that is to say some of the camber lines of the blade tip-side profiles).

The invention is based on the knowledge that losses in the radial gap can be reduced if a gap vortex, which is also responsible for the losses, is correspondingly influenced. According to the invention, the gap vortex, which is created and driven along by the gap mass flow, is now to develop later, i.e. at a point further downstream, compared with a conventional blade airfoil tip profile. The gap vortex, which therefore develops later in relation to the conventional profile, can be explained by a lower loading of the improved profile at the leading edge. Contrary to the previous general attempts to altogether weaken the gap vortex, according to the invention a stronger local impulse for creating the gap vortex is now to be generated, wherein its fluidic support is then to be decreased significantly more sharply, however, than in the case of the conventional profile. Overall, this leads to low flow losses in the radial gap. In order to create the desired gap vortex, at least some of the camber lines, preferably all the camber lines, of the blade tip-side profiles have at least two inflection points. Due to the presence of two inflection points in the camber line and by using a conventional thickness distribution, the blade tip-side profiles, and also the suction-side contour and the pressure-side contour, have a kink which to the eye of the person skilled in the art is rather unusual and which with regard to the profile in question is subsequently referred to as a profile kink. At its location, the profile kink as such creates a local increase of the gap mass flow, which, as desired, drives the gap vortex along more intensely than previously and drives it away from the suction side of the blade airfoil. In the downstream zone behind the kink in the suction-side contour, the mass flow density in the radial gap decreases significantly more sharply than when using previous profilings on the blade airfoil tip. Overall, a reduced gas mass flow thus ensues compared with conventional profilings. Due to the suction-side contour of the profile kink, the gap vortex develops along a line which also has a kink downstream of the kink of the suction-side contour. The early kinking of the gap vortex coincides with the sharp increase of the mass flow density in the radial gap to its maximum and to the ensuing decrease of said mass flow density. The gap vortex line after its kink projects at a larger angle from the suction-side wall than is the case with the conventional profile. As a result of this, the gap vortex from then on breaks away from the suction side by a distance which becomes greater than in the case of the conventional profiling. The larger angle is due to the larger gradient of the mass flow density of the gap flow both when increasing and when decreasing. Overall, the profiling according to the invention creates less radial gap losses and a lower degree of blocking of the flow field at the exit of the rotor blade row.

As a result of the achieved reduction of the radial gap losses, the efficiency of the blading and therefore also the efficiency of turbomachine equipped with the compressor rotor blading can be significantly improved.

Advantageous developments are disclosed in the dependent claims.

Preferably, the first of the two inflection points, with a perpendicular projection onto the profile chord, defines a first projection point on this, which is at a distance from the leading edge point of between 10% and 30% of the length of the profile chord. At the same time, the second of the two inflection points, with a perpendicular projection onto the profile chord, defines a second projection point on this, which is at a distance of between 30% and 50% of the length of the profile chord from the leading edge point. In particular, the advantages which are associated with the invention occur to a particularly high degree with inflection points arranged in such a way. The two inflection points in this case are apart by at least 3% of the length of the profile chord.

According to a further preferred development of the invention, the camber lines of the profiles comprise a front section which in each case extends from the leading edge point to an end point of the front section, the projection point of which, with a perpendicular projection onto the profile chord, is at a distance of between 2% and 10% of the length of the profile chord from the leading edge point, wherein at least some of the front sections, preferably all of the front sections, of the blade tip-side profiles have a curvature radius which is larger than 100-times the profile chord. In other words, the front sections of the camber line of blade tip-side profiles correspond in each case to a straight line, or at least almost. Consequently, the profile in the front section in question is symmetrical—practically without a curvature—which means that practically no pressure potential from the pressure side to the suction side develops even from the local velocity distribution around the blade tip-side leading edge region of the blade airfoil. Since the pressure potential between the pressure side and the suction side in the leading edge region is seen as a cause of the development of the gap vortex and therefore as a cause of the gap losses, this unloading of the leading edge region in this case brings about a weakening and a delayed, i.e. downstream, emergence of the gap vortex. The suction-side contour and the pressure-side contour of blade tip-side profiles in the front section of the camber line are preferably symmetrically formed in this case or formed in a wedge shape with almost rectilinear contour sections on the suction side and the pressure side.

According to a further advantageous development, each front section has an incident angle in relation to an oncoming gas flow, wherein in addition to, or instead of, the almost straight front camber line section at least some of the incident angles, preferably, however, all the incident angles, of the blade tip-side profiles are smaller than the incident angles of the remaining profiles of the blade airfoil. The incident angle of the front camber line section of blade tip-side profiles in this case are preferably less than 10°, preferably even equal to 0°. In other words, the inlet metal angle of the blade tip-side profiles is significantly smaller than the inlet metal angle of the remaining profiles of the blade airfoil. It can therefore be said that the leading edge region of the blade airfoil tip, contrary to the solution according to SU 1751430 A1, is turned into the inflow, which equally ensures that a pressure potential between the pressure side and the suction side in the leading edge region on the blade tip side is avoided. Also, this prevents the creation of the gap vortex in the leading edge region.

Alternatively to or in addition to the proposed developments, preferably at least some of the leading edge points, preferably all the leading edge points, of the blade tip-side profiles can be arranged further upstream than the leading edge points of the remaining profiles of the blade airfoil. In other words, the leading edge of the profiles for blade airfoil tips, by extending the profile forwards—in the upstream direction—is shifted forward in relation to the remaining leading edge. This has the result that no radial pressure gradient can act in the leading edge region of the blade airfoil tip so that even with the radial pressure distribution a potential between the pressure side and the suction side cannot occur.

Preferably, only the camber lines of the profiles existing in the region of the blade airfoil tip have two inflection points, wherein the blade airfoil tip side comprises a region of no more than 20% of the span from the blade airfoil tip. The remaining region of the blade airfoil, from a fastening-side blade airfoil end to a blade airfoil height of no less than 80% of the span, can be profiled according to conventional type.

Consequently, the invention refers principally to a modified blade airfoil tip of compressor rotor blades, arranged in a ring, for axial compressors.

According to a further advantageous development, the camber lines comprise a rear section which extends in each case from a starting point of the rear section to the trailing edge point, wherein the rear section of at least some, preferably all the blade tip-side camber lines, has a larger curvature than the rear sections of camber lines of the remaining profiles of the blade airfoil. Consequently, the exit metal angles of blade tip-side profiles are smaller than the exit metal angles of profiles halfway along the span or in the region of the fastening-side, i.e. hub-side, blade airfoil end. Preferably, the section starting point of the rear camber line section, with a perpendicular projection onto the profile chord, defines a projection point which is arranged on the profile chord and is at a distance of 60% at most of the length of the profile chord from the leading edge point. The trailing edge is consequently curved more in the blade tip-side region than in the remaining region of the blade airfoil. The increased curvature leads to a greater work conversion in the preferably rear 40% of the blade airfoil so that overall the loading of the blade airfoil is shifted to the rear. This design can serve as compensation for the unloading at the leading edge in order to still achieve a high work conversion despite the unloading of the blade tip-side profile in the front region of the profile chord. Overall, therefore, by reducing the barrier in the blade airfoil tip region of the compressor rotor blade the inflow of the subsequent stator blade in the outer annular wall region can also be improved. This reduces the local misaligned inflow of the subsequent stator blades.

Preferably, at least some, preferably all, the blade tip-side profiles are configured in the "aft-loaded design" and the remaining, i.e. not on the blade tip side, profiles are configured in the "front-loaded design".

The gap vortex, which is responsible for the gap losses, can be exceptionally efficiently influenced if the suction-side contour and the pressure-side contour also have at least three consecutive curvature sections with alternating signs, which adjacent curvature sections adjoin at an inflection point in each case. This can be achieved with a suitable thickness distribution which is applied in a conventional way perpendicularly and symmetrically to the camber line, i.e. on both sides in equal measures. Such measures lead to concave contour sections on the suction side and to convex contour sections on the pressure side, by which the gap vortex can be ideally influenced in a particularly simple way.

The blade airfoil tip is expediently of an unshrouded design.

If a velocity distribution of the gas is established along the suction-side contour from the leading edge point to the trailing edge point during a circumflow by a gas, at least some, preferably all, blade tip-side profiles are selected so that at a maximum location a velocity maximum occurs, the projection point of which, with a perpendicular projection onto the profile chord, is at a distance on this of between 10% and 30% of the length of the profile chord from the leading edge point. This measure ensures a particularly large impulse for the development of the gap vortex. In order to then minimize the radial gap losses as far as possible, it is provided that the energy feed for the gap vortex decreases especially quickly, i.e. over a particularly short length, to a particularly intense degree. To this end, it is provided that the profiles in question are selected so that in a suction-side section of the suction-side contour adjoining the maximum location, with a length of 15% at most of the length of the profile chord, a gradient of the velocity is established, the slope of which gradient is maximum. This leads to the gap vortex being greatly undersupplied for its size, which leads to this moving away from the surface of the suction side at a larger angle. This leads to particularly low gap losses in the case of an axial compressor, the rotor of which is equipped with the compressor rotor blades according to the invention.

BRIEF DESCRIPTION OF THE DRAWINGS

The further explanation of the invention follows, based on the exemplary embodiment which is represented in the drawing.

In the drawing, in detail.

DETAILED DESCRIPTION OF INVENTION

Figure 9:
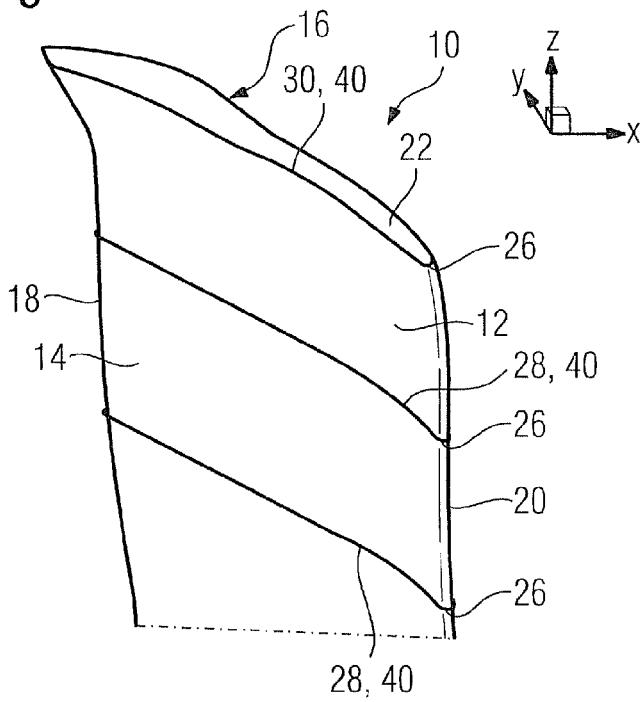
FIGS. 9, 10 show perspective views of the unshrouded blade airfoil tip of a compressor rotor blade according to the invention.
Figure 10:
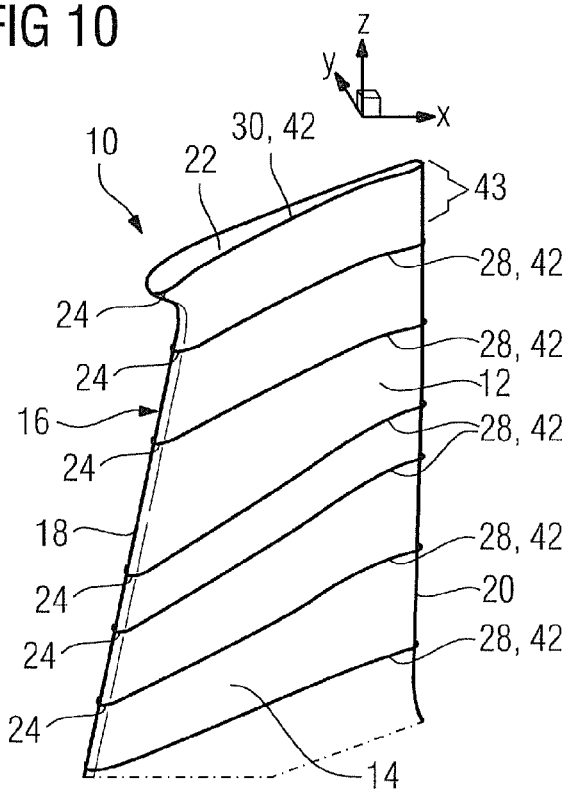

FIG. 9 and FIG. 10 show in each case an unshrouded compressor rotor blade 10 from different perspectives. Its blade airfoil 12 comprises a pressure-side wall 14 and a suction-side wall 16 which, on the one hand, extend in each case from a common leading edge 18, onto which flows a gas flow, to a common trailing edge 20, and, on the other hand, extend from a fastening-side blade airfoil end, not additionally shown in FIG. 9 and FIG. 10, to a blade airfoil tip 22, forming a span.

In FIG. 9, the perspective is selected so that the view falls upon the trailing edge 20 of the blade airfoil 12, and in FIG. 10 the view falls upon the leading edge 18 of the blade airfoil 12. On the fastening-side blade airfoil end, provision can be made in a known manner for a platform and also for a blade root which is arranged thereupon. Depending upon the type of fastening, the blade root of the compressor rotor blade 10 is either of a dovetail-shaped, fir tree-shaped, or inverted T-shaped design. The compressor rotor blade can also be welded on a rotor.

Fixed in the rotor of an axial compressor, the orientation of the blade airfoil 12 is such that the blade airfoil 12 extends from the leading edge 18 to the trailing edge 20 in approximately the axial direction of the axial compressor, which in the coordinate system associated with FIG. 9 and FIG. 10 is identified by the axis X. The radial direction of the axial compressor coincides with the Z-axis of the depicted coordinate system, and the tangential direction, i.e. the circumferential direction, coincides with the Y-axis.

A span of the blade airfoil 12 is therefore covered in the direction of the Z-axis.

As is generally known, compressor rotor blades 10 for axial compressors are designed in such a way that different or even identical profiles are arranged in series along a rectilinear or even slightly curved stacking axis, which is not shown, the included space of which defines the blade airfoil 12. Each profile in principle has a surface center of gravity which lies on the stacking axis.

In detail, an endless reference line, which comprises a suction-side contour and a pressure-side contour of a blade airfoil, is understood by a profile. The contours meet on one side at a leading edge point and on the other side at a trailing edge point, which points are also part of the profile and in this case lie on the corresponding edge of the blade airfoil. Such a profile exists for each blade airfoil height which exists along the span. In this respect, the profile represents the contour of a cross section through the blade airfoil for a specific blade airfoil height, wherein the cross section can be oriented either perpendicularly to the radial direction of the axial compressor or at a slight inclination thereto, corresponding to an annular passage constriction. In FIG. 9, pressure-side contours 40 of three profiles 28, 30 are shown by way of solid lines. In FIG. 10, a plurality of suction-side contours 42 of profiles 28, 30 of different blade airfoil heights are also shown by way of solid lines.

The curved blade airfoil 12 shown in FIG. 9 and FIG. 10 has a blade airfoil tip region 43 which, compared with the prior art, is modified according to the invention and the specific design and functioning principle of which are described in more detail below.

Figure 1:
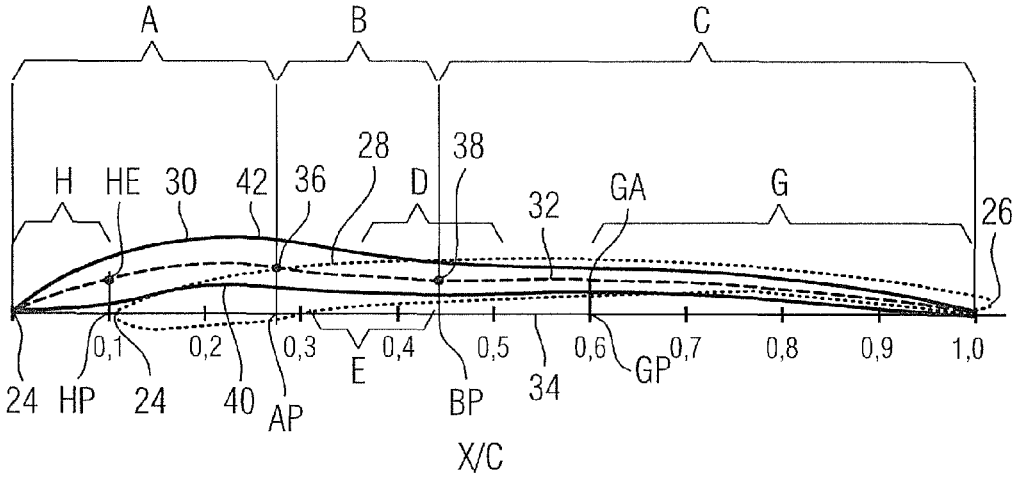
FIG. 1 shows a profile according to the invention and a profile known from the prior art for a compressor rotor blade.

In FIG. 1, two basically different profiles 28, 30 are shown. The first profile 28, shown by way of dotted lines, shows a cross section through the compressor rotor blade 10 according to FIG. 10 at a blade airfoil height of half the span of the blade airfoil 12. The profile 28 can be a conventional profile which is known from the prior art. The profile 30, which is shown by way of solid lines, shows a cross section through the compressor rotor blade 10 according to the invention according to FIG. 10 in the region 43 of the blade airfoil tip 22. Each profile 28, 30 according to FIG. 1 has a camber line associated with it, wherein for reasons of clarity only the one camber line 32 of the blade tip-side profile 30 is shown in FIG. 1 by way of dashed lines. The camber line 32 begins at a leading edge point 24, ends at an associated trailing edge point 26, and is always located centrally between the pressure-side contour 40 and the suction-side contour 42. It is also known as the profile center line.

In addition to the camber line 32, profiles are also defined in the prior art by means of a rectilinear profile chord. The profile chord is a straight line which extends from the leading edge point to the trailing edge point. In FIG. 1, only the one profile chord 34 for the blade tip-side profile 30 is shown. Since the profile chord 34 is subsequently used for geometric definition of significant points of the profile 30, its length is normalized to one, wherein the length of the profile chord is 0% at the leading edge point 24 and the length of the profile chord is 100% at the trailing edge point 26. A relative chord length is also understood by this.

Naturally, a profile chord also exists for the profile 28 which is known from the prior art. This profile chord, however, is not shown in FIG. 1 for the sake of clarity.

The normalized profile chord 34 is indicated in this case by x/c. The profile 30 shown in FIG. 1 in this case is representative for the radially outermost of the blade tip-side profiles 30. The conventional profile 28 shown in FIG. 1 on the one hand is representative for the profiles which are known from the prior art and, on the other hand, is representative for the remaining profiles of the compressor rotor blade 10. Those profiles which are not arranged on the blade tip side and therefore can be arranged in the fastening-side region of the blade airfoil 12 or centrally between the blade airfoil tip 22 and the fastening-side blade airfoil end, for example, are to be understood by the remaining profiles 28. The transition from the conventional profile 28 to the blade tip-side profile 30 takes place in this case in a stepless manner, as shown in FIG. 10.

It is characteristic for a compressor rotor blade 10 according to the invention that the camber lines 32 of the blade tip-side profiles 30 have at least two inflection points 36, 38. This means that upstream of the most forward inflection point 36 the camber line 32 has a first curvature section A with a first curvature, and downstream of the first inflection point 36 up to the second inflection point 38 the camber line has a second curvature section B with a second curvature. The signs of the first curvature and of the second curvature in this case are different. Adjoining downstream of the second curvature section B at a second inflection point 38 is a third curvature section C, the curvature of which again has a sign which is different to that of the second curvature. As a result of the different signs of the curvatures of the curvature sections A, B, C, the suction-side contour 42 and the pressure-side contour 40 also have corresponding curvature sections. The mainly convexly curved suction-side contour 42, in a section D of between 35% and 50% of the relative chord length, has a concave shape. The mainly concavely curved pressure-side contour 40 has a section E which is convex. Contrary to the previous profile shapes—which are known from the prior art—for compressor rotor blades of axial compressors, this concave suction-side contour section D and this convex pressure-side contour section E lead to a locally kinked profiling which is referred to here as a profile kink.

It is provided in this case that the first of the two inflection points 36, with a perpendicular projection onto the profile chord, defines a first projection point AP on this, which is at a distance of between 10% and 30% of the length of the profile chord 34 from the leading edge point 24, and in which the second of the two inflection points 38, with a perpendicular projection onto the profile chord 34, defines a second projection point BP on this, which is at a distance of between 30% and 50% of the length of the profile chord 34 from the leading edge point 24. Furthermore, it clearly emerges from FIG. 1 that the blade tip-side profile 30, compared with the conventional profile 28, has a leading edge 18 which is displaced forwards towards the oncoming gas flow. The forwards-displaced leading edge 18 of the blade tip-side profile 30 is particularly apparent in the perspective views according to FIG. 9 and FIG. 10.

Furthermore, it is provided that the camber line 32 of blade tip-side profiles 30 has a greater curvature in a rear section G than the rear sections of camber lines of the remaining profiles 28 of the blade airfoil 12. The rear section G of the camber line 32 extends from the section starting point GA to the trailing edge point 26 of the camber line 32, which section starting point GA, with a projection onto the profiled chord 34, defines a projection point GP on this, which is at a distance of 60% at most of the length of the profile chord 34 from the leading edge point 24.

Furthermore, it emerges from FIG. 1 that the blade tip-side profile 30 comprises a camber line 32 with a front section H. The front section H of the camber line 32 extends from the leading edge point 24 to a projection point HP of the camber line 32, which is arranged at 10% of the length of the profile chord 34. The projection point HP is created in this case by the projection of an end point HE of the front section H perpendicular to the profiled chord 34. In this front section H of the camber line 32, the camber line 32 is almost uncurved, i.e. approximately straight. Similarly, the thickness distribution, which as generally known is applied perpendicularly to the camber line 32 on both sides in equal measures, is selected in this case so that a leading edge region, which in principle is wedge-shaped, is created for the blade tip-side profile 30. In general, in the front section H of blade tip-side profiles 30 a symmetrical progression of the suction-side contour 42 and pressure-side contour 40 is symmetrically desirable.

Figure 2:
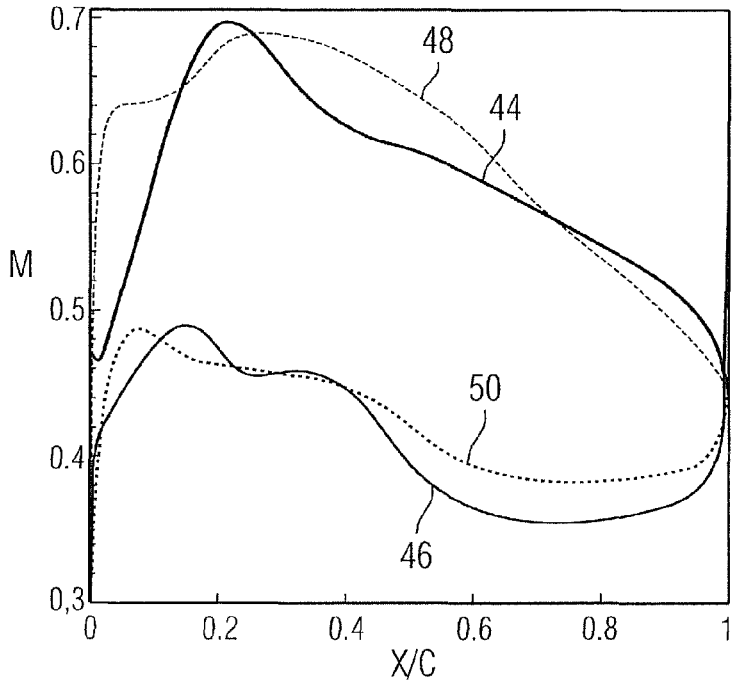
FIGS. 2, 3, 6 show the velocity distributions along the suction-side contour and the pressure-side contour of the profile according to the invention and of the conventional profile from FIG. 1.

In FIG. 2, the velocity distributions along the blade tip-side profile 30 and along the conventional profile 28 both for the suction-side flow and for the pressure-side flow are contrasted. Each velocity distribution is plotted in this case along the normalized profile chord x/c. The velocities in this case are specified in Mach numbers, wherein Mach=1 signifies the speed of sound for a given temperature. The velocity distribution has been recorded in this case at that blade airfoil height of compressor rotor blades which is at a distance from the blade airfoil tip 22 of 0.5% of the gap dimension of a radial gap between the blade airfoil tip 22 and the annular wall of the axial compressor encompassing this gap. The velocity distributions 48, 50 of a conventional profile 28 for the suction-side wall 16 and the pressure-side wall 14 are shown by way of dashed lines in FIG. 2, FIG. 3 and FIG. 6. The velocity distributions 44, 46 for the suction-side wall 16 and the pressure-side wall 14 of the blade tip-side profile 30 are represented by way of solid lines. The lower line in each case represents the velocity distribution for the corresponding pressure side, and the upper line in each case represents the velocity distribution for the corresponding suction side. The suction-side velocity distribution for the blade tip-side profile 30 is designated 44, the pressure-side velocity distribution for the blade tip-side profile is designated 46, the suction-side velocity distribution for the conventional profile 28 is designated 48 and the pressure-side velocity distribution for the conventional profile 28 is designated 50. The greater the distance is between the curve of the suction-side velocity distribution 44, 48 and the pressure-side velocity distribution 46, 50 for each point of the normalized profile chord 34, the greater the pressure difference is and therefore the greater the loading is on the respective considered point of the profile chord of the respective considered profile 28, 30. From FIG. 2, it emerges that by means of the blade airfoil tip region 43 which is modified according to the invention, the blade airfoil 12 has been unloaded in the front half, i.e. particularly on the first 15% of the profile chord 34 as seen from the leading edge point 24.

As a result of the ensuing velocity distributions 44, 46, a higher loading occurs in the rear section G of the blade tip-side profile 30 since the area between the suction-side velocity distribution 44 and the pressure-side velocity distribution 46 for a rear profile section from 60% of the profile chord 34 to 100% of the profile chord 34 is larger than the corresponding area between the corresponding velocity distributions 48, 50 of the conventional profile 28 which is known from the prior art. Since the conventional profile 28 is provided for regions of the compressor rotor blade 10 which are not on the blade tip side, a change of the loading from the front section of the blade airfoil ("front-loaded design") to the rear section of the blade airfoil ("aft-loaded design") therefore occurs along the blade airfoil height. It is characteristic that the profile shape of the blade airfoil 12 on the blade tip side is selected so that the velocity increase to a velocity maximum at a maximum location at about 20% of the length of the profile chord 34 is achieved within a profile chord section which is as short as possible. Furthermore, in the subsequent 15% of the profile chord 34 adjoining the maximum location, a comparatively large reduction of the velocity of the suction-side gas flow is desired within a profile chord section which is as short as possible. In particular, this velocity progression along the suction-side wall 16 leads to a gap vortex—which is responsible for the gap losses—being created with comparatively more energy, wherein as a result of the large velocity regression after the velocity maximum has been achieved, only comparatively little energy is additionally fed to this, however, which then weakens it all the more. This leads overall to reduced radial gap losses.

Figure 3:
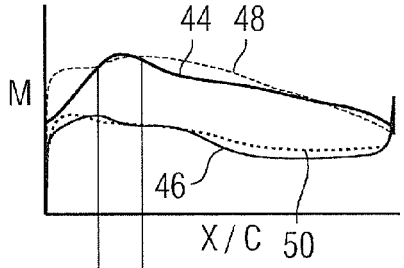
Figure 6:
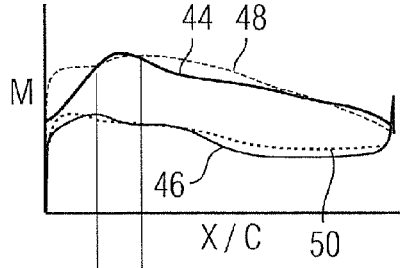
Figure 4:
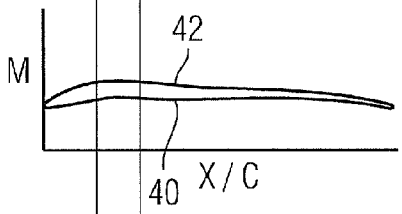
FIG. 4 shows the contour of the suction side and the pressure side of the profile according to the invention for a compressor rotor blade.
Figure 5:
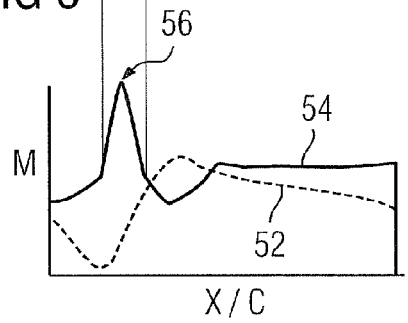
FIG. 5 shows the curvature progression of the profile according to the invention along the suction side and the pressure side.

The illustrations 3 to 8 give a further view of the effects which occur as a result of the profile kink. In FIG. 3 and FIG. 6, the Mach number distributions of the conventional profile 28 and of the blade tip-side profile 30 over the relative chord length are again shown. FIG. 4 describes the blade tip-side profile 30 in the unstaggered m'-theta coordinate system. The lower illustration, FIG. 5, shows a curvature 52 of the suction-side contour 42 and a curvature 54 of the pressure-side contour 40 over the m'-coordinates. It is clear to see that in the region of a pressure-side kink 56 a sharp rise of the Mach number difference develops and therefore a sharp rise of the pressure potential between the suction-side contour 42 and the pressure-side contour 40.

Figure 7:
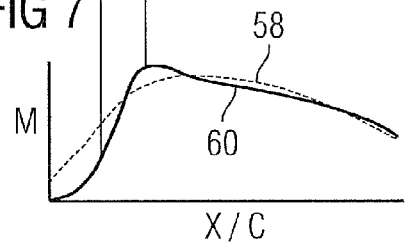
FIG. 7 shows the density of the mass flow in a radial gap when using a profile according to the invention for an unshrouded blade airfoil tip.

FIG. 7 shows the density of the mass flow, which flows through the radial gap orthogonally to the profile chord 34, with regard to the considered local area. The mass flow density for a conventional profile 28 is designated 58, and for the blade tip-side profile 30 is designated 60. For the blade tip-side profile 30, a clearer relationship between the increase of the pressure potential and the increase of the mass flow density in the radial gap is seen. The mass flow density in the radial gap reaches it global maximum, moreover, shortly after the described profile kink. The global maximum of the mass flow density for the blade tip-side profile 30 is higher than in the conventional case. The decrease of the mass flow density in the radial gap after its maximum is also greater than in the case of the conventional profiling 28.

Figure 8:
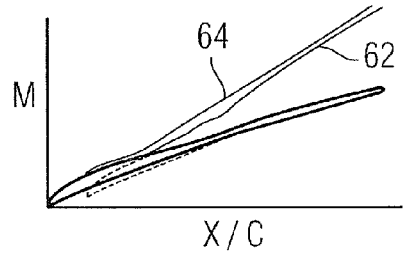
FIG. 8 shows the topology of the gap vortex trajectories for the profile according to the invention and for the conventional profile.

FIG. 8 shows the topology of the gap vortex trajectories (gap vortex lines) for the two profiles 28, 30. The gap vortex line for the conventional profile 28 is designated 62 and the gap vortex line for the blade tip-side profile is designated 64. The gap vortex in the case of the blade tip-side profile 30 develops considerably later relative to the leading edge 18—with regard to the relative chord length of the profile in question—and then kinks from the suction-side wall 16 at a larger angle than in the case of the conventional profiling 28. The early kinking of the gap vortex coincides with the sharp increase of the mass flow density to its maximum and with the subsequent decreasing of the mass flow density. The larger angle is due to the steeper gradient both during the increase and during the decrease of the mass flow density. The late development of the gap vortex in relation to the conventional profile 28 can be explained by the low loading of the improved profile 30 at the leading edge 18.

As a result of the unloading of the blade airfoil tip 22 in the leading edge region, the forming of the gap vortex is delayed. Subsequently, in the region of the suction-side profile kink, a sharp increase of the gap mass flow ensues, driving the gap vortex along and driving it away from the suction-side wall 16 of the blade tip-side profile 30. In the zone downstream of the suction-side profile kink, the mass flow density in the radial gap falls significantly more sharply than in the case of the conventional profiling 28. Overall, a smaller gap mass flow thereby ensues. The gap vortex line kinks downstream of the suction-side profile kink at a greater angle from the suction-side wall 16 than is the case with the conventional profiling 28. From then on, it moves away at a greater distance from the suction-side wall 16 than in the case of the conventional profiling 28. Overall, the gap flow in the case of the modified profiling 30 therefore causes fewer losses and a lower degree of blocking of the flow field at the exit of the rotor blade row. In order to still achieve a high work conversion, despite the unloading of the profile 30 in the front half of the profile chord 34, the loading is increased by means of a higher camber of the profile 30 in the rear 40% of the profile chord 34.

Especially preferred is the design in which the interaction of the shift of the loading from the front rearwards with the specific curvature distribution of the new profile 30 is established at about 20% of the profile chord 34.

In particular, the compressor blades which are specified in the following table—the remaining profiles of which correspond largely to the profile shape 28 depicted in FIG. 1—have been proved to be especially effective.

TABLE 1

| Parameter: | Blade No. 1 | Blade No. 2 |
|---|---|---|
| Position of the first inflection point (AP) of the camber line [percentage of the profile chord length] | 28 | 18 |
| Position of the second inflection point (BP) of the camber line [percentage of the profile chord length] | 49 | 47 |
| Length of the uncurved leading edge [percentage of the profile chord length] | 10 | 5 |
| Incident angle of the blade tip-side profiles [degree] | 5 | 7 |
| Incident angle of the remaining profiles [degree] | 25 | 25 |
| Position of the section starting point GA [percentage of the profile chord length] | 51 | 53 |
| Curvature of the blade tip-side profiles in the rear section [ ] | 1/(2 * profile chord length) | 2/profile chord length |
| Curvature of the remaining profiles in the rear section [ ] | 1/(10 * profile chord length) | 1/(10 * profile chord length) |
| Length of the blade tip-side region [percentage of the span] | 20 | 10 |
| Position of the suction-side, blade tip-side velocity maximum [percentage of profile chord length] | 20 | 10 |
| Length of the maximum gradient of the suction-side velocity distribution downstream of the location of the velocity maximum [percentage of profile chord length] | 10 | 10 |

Overall, the invention therefore refers to a compressor rotor blade 10 for axial flow compressors of preferably stationary gas turbines. The invention provides that for reducing radial gap losses the camber line 32 of the blade tip-side profile 30 of the blade airfoil 12 of the compressor rotor blade 10 has at least two inflection points 36, 38. By the provision of two inflection points 36, 38, a suction-side contour section D, which is of a concave shape, is created for the suction-side contour 42 in the section from 35% to 50%, and a pressure-side contour section E, which is of a convex shape, is created for the pressure-side contour 40. By means of this geometry, it is possible to generate lower-loss gap vortices in order to increase the overall efficiency of an axial compressor which is equipped with these compressor rotor blades 10.

The invention claimed is:

1. A compressor rotor blade for an axial compressor, comprising:

a curved blade airfoil which includes a pressure-side wall and a suction-side wall which in one direction, extend in each case from a common leading edge to a common trailing edge and, and in another direction extend from a fastening-side blade airfoil end to a blade airfoil tip, forming a span, wherein for each blade airfoil height which exists along the span the blade airfoil includes:

a profile with a suction-side contour and a pressure-side contour, an at least partially curved camber line, and a rectilinear profile chord, wherein the suction-side contour and the pressure-side contour, camber line and profile chord extend in each case from a leading edge point to a trailing edge point, wherein at least some of the camber lines of the blade tip-side profiles includes at least two inflection points.

2. The compressor rotor blade as claimed in claim 1, wherein a first inflection point, with a perpendicular projection onto the profile chord, defines a first projection point, which is at a distance of between 10% and 30% of the length of the profile chord from the leading edge point, and wherein a second inflection point, with a perpendicular projection onto the profile chord, defines a second projection point, which is at a distance of between 30% and 50% of the length of the profile chord from the leading edge point.

3. The compressor rotor blade as claimed in claim 2, wherein the camber lines include a front section, which extends from the leading edge point to a section end point, the projection point of which front section, with a perpendicular projection onto the profile chord, is at a distance of between 2% and 10% of the length of the profile chord from the leading edge point, and wherein at least some of the front sections of the blade tip-side profiles have a curvature radius which is larger than 100-times the profile chord.

4. The compressor rotor blade as claimed in claim 3, wherein each front section includes an incident angle in relation to an oncoming gas flow, and wherein at least some of the incident angles of the blade tip-side profiles are smaller than the incident angles of the remaining profiles of the blade airfoil.

5. The compressor rotor blade as claimed in claim 4, wherein the incident angle of the front section of blade tip-side profiles is less than 10°.

6. The compressor rotor blade as claimed in claim 3, wherein the suction-side contour and the pressure-side contour of the blade tip-side profiles in the front section of the camber line are of a symmetrical design.

7. The compressor rotor blade as claimed in claim 1, wherein at least some of the leading edge points of the blade tip-side profiles are arranged further upstream than the leading edge points of the remaining profiles of the blade airfoil.

8. The compressor rotor blade as claimed in claim 1 wherein only the camber lines of the profiles existing in the region of the blade airfoil tip have two inflection points.

9. The compressor rotor blade as claimed in claim 1 wherein the camber lines comprise a rear section which extends from a section starting point to the trailing edge point, and wherein the rear section of at least some of the blade tip-side camber lines has a greater curvature than the rear sections of camber lines of the remaining profiles of the blade airfoil.

10. The compressor rotor blade as claimed in claim 9, wherein the section starting point, with a perpendicular projection onto the profile chord, defines a projection point which is arranged on the profile chord and is at a distance of 60% at most of the length of the profile chord from the leading edge point.

11. The compressor rotor blade as claimed in claim 1, wherein the suction-side contour and the pressure-side contour of blade tip-side profiles have at least two inflection points in each case.

12. The compressor rotor blade as claimed in claim 1, wherein the blade airfoil tip is unshrouded.

13. The compressor rotor blade as claimed in claim 1, wherein at least some of the blade tip-side profiles are configured in an aft-loaded design and the remaining profiles are configured in a front-loaded design.

14. The compressor rotor blade as claimed in claim 1, wherein the blade airfoil tip side comprises a region of 20% at most of the span of the blade airfoil tip.

15. The compressor rotor blade as claimed in claim 1, wherein a velocity distribution of the gas is established along the suction-side contour from the leading edge point to the trailing edge point during a circumflow by a gas, and wherein at least some of the blade tip-side profiles are selected so that at a maximum location a velocity maximum occurs, the projection point of which velocity maximum, with a perpendicular projection onto the profile chord, is at a distance of between 10% and 30% of the length of the profile chord from the leading edge point.

16. The compressor rotor blade as claimed in claim 15, wherein the profiles in question are selected so that in a suction-side section of the suction-side contour adjoining the maximum location, with a length of 15% at most of the length of the profile chord, a gradient of the velocity is established, the slope of which is maximum.

17. An axial compressor with a rotor, comprising:

a rotor blade ring with compressor rotor blades on the outer periphery of the axial compressor, wherein each rotor blade is as claimed in claim 1.

18. The compressor as claimed in claim 17, wherein a first inflection point, with a perpendicular projection onto the profile chord, defines a first projection point, which is at a distance of between 10% and 30% of the length of the profile chord from the leading edge point, and wherein a second inflection point, with a perpendicular projection onto the profile chord, defines a second projection point, which is at a distance of between 30% and 50% of the length of the profile chord from the leading edge point.

19. The compressor as claimed in claim 18, wherein the camber lines include a front section, which extends from the leading edge point to a section end point, the projection point of which front section, with a perpendicular projection onto the profile chord, is at a distance of between 2% and 10% of the length of the profile chord from the leading edge point, and wherein at least some of the front sections of the blade tip-side profiles have a curvature radius which is larger than 100-times the profile chord.

20. The compressor as claimed in claim 19, wherein each front section includes an incident angle in relation to an oncoming gas flow, and wherein at least some of the incident angles of the blade tip-side profiles are smaller than the incident angles of the remaining profiles of the blade airfoil.

* * * * *